US008205294B2

(12) United States Patent
Kim et al.

(10) Patent No.: US 8,205,294 B2
(45) **Date of Patent: *Jun. 26, 2012**

(54) VACUUM CLEANER HAVING SUCTION PATH SWITCHING UNIT

(75) Inventors: See-hyun Kim, Gwangju (KR); Joung-soo Park, Jeollabuk-do (KR); Byung-jo Lee, Gwangju (KR); Jung-gyun Han, Gwangju (KR); Tae-gwang Kim, Gwangju (KR)

(73) Assignee: Samsung Electronics Co., Ltd., Gwangsan-gu, Gwangju-si (KR)

( * ) Notice: Subject to any disclaimer, the term of this patent is extended or adjusted under 35 U.S.C. 154(b) by 1002 days.

This patent is subject to a terminal disclaimer.

(21) Appl. No.: 12/220,789

(22) Filed: Jul. 28, 2008

(65) Prior Publication Data

US 2009/0089961 A1 Apr. 9, 2009

Related U.S. Application Data

(63) Continuation-in-part of application No. 12/074,824, filed on Mar. 6, 2008, now Pat. No. 8,032,982.

(30) Foreign Application Priority Data

Oct. 8, 2007 (KR) ..... 2007-101074
Mar. 19, 2008 (KR) ..... 10-2008-0025616

(51) Int. Cl.
*A47L 9/00* (2006.01)

(52) U.S. Cl. ..... 15/331; 15/334

(58) Field of Classification Search ..... 15/331, 15/334, 335, 328, 410; *A47L 9/00*
See application file for complete search history.

(56) References Cited

U.S. PATENT DOCUMENTS

| | | | | |
|---|---|---|---|---|
| 4,377,882 | A | 3/1983 | Dyson | 15/335 |
| 4,573,236 | A | 3/1986 | Dyson | |
| 5,477,586 | A | 12/1995 | Jacobs et al. | 15/332 |
| 7,559,112 | B2 | 7/2009 | Lee et al. | |
| 2004/0194247 | A1 | 10/2004 | Macleod et al. | |
| 2006/0026789 | A1 | 2/2006 | Fischer et al. | |
| 2006/0282976 | A1 | 12/2006 | Richardson et al. | |

FOREIGN PATENT DOCUMENTS

EP 1464267 10/2004

OTHER PUBLICATIONS

Search and Examination Report dated Nov. 14, 2008 corresponding to United Kingdom Patent Application No. 0813024.7.

*Primary Examiner* — David Redding
(74) *Attorney, Agent, or Firm* — Ohlandt, Greeley, Ruggiero & Perle, L.L.P.

(57) ABSTRACT

A vacuum cleaner having a suction path switching unit is provided that includes a cleaner body having a body frame; a suction inlet body hinged to the body frame; an extension pipe assembly having a hose and an extension pipe connected in fluid communication with the hose; and a suction path switching unit disposed on the body frame. The suction path switching unit has a switching duct, at least a portion of which is elastically arranged on a suction path to be displaceable on the suction path. As the extension pipe is fixed on or separated from the body frame, the switching duct is selectively displaced to a first position of opening a first suction path flowing from the suction inlet body to the dust collecting unit or a second position of opening a second suction path flowing from the extension pipe to the dust collecting unit.

16 Claims, 9 Drawing Sheets

VACUUM CLEANER HAVING SUCTION PATH SWITCHING UNIT

CROSS-REFERENCE TO RELATED APPLICATIONS

This application is a continuation-in-part of application Ser. No. 12/074,824, filed Mar. 6, 2008 now U.S. Pat. No. 8,032,982, in the United States Patent and Trademark Office, which has claimed the benefit under 35 U.S.C. §119(a) from Korean Patent Application No. 10-2007-0101074, filed on Oct. 8, 2007, in the Korean Intellectual Property Office; and claims the benefit under 35 U.S.C. §119(a) from Korean Patent Application No. 10-2008-25616, filed on Mar. 19, 2008, in the Korean Intellectual Property Office, the disclosures of each of which are incorporated herein by reference in their entirety.

BACKGROUND OF THE INVENTION

1. Field of the Invention

The present disclosure relates to a vacuum cleaner, and more particularly, to a vacuum cleaner that is capable of selecting a suction path from a suction inlet body or from an extension pipe connected to a cleaner body to draw in dust from a surface to be cleaned using a suction force generated by operation of a motor in the cleaner body.

2. Description of the Related Art

In general, a vacuum cleaner is largely divided into an upright-type vacuum cleaner and a canister-type vacuum cleaner.

The upright-type vacuum cleaner has a suction inlet body directly connected to a cleaner body without passing through an extra hose or an extension pipe. Thus, the upright-type vacuum cleaner can bring the suction inlet body in close contact with a surface to be cleaned using a weight of the vacuum cleaner, thereby largely improving a cleaning efficiency when cleaning a carpet.

The canister-type vacuum cleaner differs from the upright-type vacuum cleaner in that a suction inlet body fluidly communicates with a cleaner body through a hose or an extension pipe. Due to this structure, the canister-type vacuum cleaner provides an unrestricted freedom of manipulating the suction inlet body compared to the upright-type vacuum cleaner. Accordingly, the canister-type vacuum cleaner can easily clean hard-to-clean areas such as floors, stairs, and narrow areas that the upright-type vacuum cleaner cannot easily reach or a user cannot easily manipulate the suction inlet body.

However, the upright-type vacuum cleaner and the canister-type vacuum cleaner are useful in cleaning environments or places corresponding thereto, respectively. Recently, thus, vacuum cleaners for use in both an upright form and a canister form are actively being developed.

The vacuum cleaner for use in both the upright form and the canister form usually includes a cleaner body, a suction inlet body connected to the cleaner body, and an extension pipe assembly detachably fixed on the cleaner body. The extension pipe assembly has a hose and an extension pipe. The extension pipe assembly is fixed on the cleaner body when the vacuum cleaner is used in the upright form, and separated from the cleaner body when the vacuum cleaner is used in the canister form. Accordingly, a first suction path, which flows from the suction inlet body to a dust collecting unit in the cleaner body, has to be opened when the extension pipe assembly is fixed on the cleaner body, and a second suction path, which flows from the extension pipe to the dust collecting unit, has to be opened when the extension pipe assembly is separated from the cleaner body. Due to this, the conventional vacuum cleaner presents a problem that after fixing or separating the extension pipe assembly on or from the cleaner body, a user has to open the first suction path or the second suction path by manually manipulating a separate apparatus.

To address the problem as described above, there has been proposed a vacuum cleaner having a suction path switching unit with a valve plate or door for switching the suction path according to an operation of fixing or separating the extension pipe assembly on or from the cleaner body, so that dust and air drawn in from a surface to be cleaned are introduced into the dust collecting unit through the suction inlet body in a upright cleaning mode and through the extension pipe in a canister cleaning mode.

However, in the vacuum cleaner as described above, since the suction path switching unit has the valve plate or door the air path in the switching unit has an angular space, which is capable of forming a vortex. As a result, a problem may occur, in that when the air passes through the suction path switching unit, the suction path-switching part generates unnecessary pressure loss and air-flowing noise in the air path.

SUMMARY OF THE INVENTION

Exemplary embodiments of the present disclosure overcome the above disadvantages and other disadvantages not described above. Also, the present disclosure is not required to overcome the disadvantages described above, and an exemplary embodiment of the present disclosure may not overcome any of the problems described above.

The present disclosure provides a vacuum cleaner that switches between suction paths by displacement of at least portion of a switching duct having a fluent or smooth air path, thereby reducing unnecessary pressure loss and air-flowing noise.

The above aspects and/or other features of the present disclosure can substantially be achieved by providing a vacuum cleaner, including a cleaner body having a suction motor, a dust collecting unit, and a body frame in which the suction motor and the dust-collecting unit are disposed; a suction inlet body hinged to a lower end of the body frame; an extension pipe assembly detachably fixed on the body frame, and having a hose and an extension pipe connected in fluid communication with the hose; and a suction path switching unit disposed on the body frame and having a switching duct, at least a portion of which is elastically arranged on a suction path to be displaceable on the suction path. As the extension pipe is fixed on or separated from the body frame, the at least portion of the switching duct is selectively displaced to a first position of opening a first suction path flowing from the suction inlet body to the dust collecting unit or a second position of opening a second suction path flowing from the extension pipe to the dust collecting unit.

Here, the switching duct may be elastically arranged on the suction path to be movable up and down on the suction path.

The suction path switching unit may further include a first suction duct, a first side of which fluidly communicates with the suction inlet body; a second suction duct, a first side of which fluidly communicates with the hose; and a guide duct which fluidly communicates with the dust collecting unit. The switching duct at a first side thereof may be in fluid communication with the guide duct and at a second side thereof, selectively fluidly communicate with one of second sides of the first suction duct and the second suction duct.

The switching duct at the first side thereof may be slidably inserted into the guide duct, and the second sides of the first suction duct and the second suction duct may be arranged on the same vertical line in a relation corresponding to a moving section of the switching duct to each other, such that the switching duct moves up or down to fluidly communicate with the first suction duct or the second suction duct, respectively.

The switching duct may further include a partition extending therefrom, the switching duct being disposed on the same vertical line so that when the switching duct is in the second position the partition blocks the first suction duct.

The switching duct, at an upper outer circumference thereof, may be formed integrally with a push projection pressed or released by the extension pipe, which is slidably inserted into a socket formed on the body frame thus to be insertable into or separatable from the socket. At this time, as the push projection is released by the extension pipe and upwardly and elastically supported by a return spring, the switching duct may fluidly communicate with the second suction duct.

Alternatively, a portion of the switching duct may be bendable and capable of expansion and contraction to switch the suction path.

In this case, the suction path switching unit may further include a first suction duct, a first side of which fluidly communicates with the suction inlet body; a second suction duct, a first side of which fluidly communicates with the hose; a guide duct, a first side of which fluidly communicates with the dust collecting unit; a housing which fluidly communicates with second sides of the first suction duct, the second suction duct and the guide duct, the switching duct being disposed in the housing, so that the portion of the switching duct is displaceable to one of the first position and the second position to be in fluid communication with the first suction duct and the second suction duct, respectively, and the rest of the of the switching duct is in fluid communication with the guide duct; and a switch operating part connected to the portion of the switching duct within the housing to selectively displace the portion of the switching duct to one of the first position and the second position in cooperation with operation of fixing or separating the extension pipe on or from the body frame.

The switching duct may include a fixing part fixed in fluid communication with the guide duct within the housing; a moving part selectively displaceable to one of the first position and the second position to be in fluid communication with one of the first suction duct and the second suction duct within the housing; and a connecting part formed to be bendable and capable of expansion and contraction and to interconnect the fixing part and the moving part. The connecting part may be a bellows type hose. A free end of the moving part fluidly communicating with the first suction duct or the second suction duct may have a gasket disposed to seal between the moving part and the first suction duct or the second suction duct.

The switch operating part may include a rotating lever, a first end of which is connected to the moving part and a first side of a second end of which is rotatably supported on the housing; a pushing part, a first side of which is hinged to a second side of the second end of the rotating lever, and a second side of which penetrates through the housing and is exposed to the outside of the housing; and a returning spring to elastically support the pushing part to push the pushing part outside the housing. The housing may have a supporting hole formed in the form of a vertical oval at an inner center of the housing, and the first side of the second end of the rotating lever may have a supporting axis displaceably supported in the supporting hole.

The switch operating part may further include a guide part to guide the rotating lever to correctly move in rotation. The guide part may be a guide rib projected from the housing within the housing to guide an outer edge of the rotating lever when the rotating lever rotates.

Other objects, advantages and salient features of the disclosure will become apparent from the following detailed description, which, taken in conjunction with the annexed drawings, discloses preferred embodiments of the disclosure.

BRIEF DESCRIPTION OF THE DRAWINGS

These and/or other aspects and advantages of the disclosure will become apparent and more readily appreciated from the following description of the embodiments, taken in conjunction with the accompanying drawings of which.

Throughout the drawings, like reference numerals will be understood to refer to like parts, components and structures.

DETAILED DESCRIPTION OF EXEMPLARY EMBODIMENTS

Hereinafter, a vacuum cleaner employing a suction path switching unit according to exemplary embodiments of the present disclosure will now be described in detail with reference to the accompanying drawings.

Figure 1:
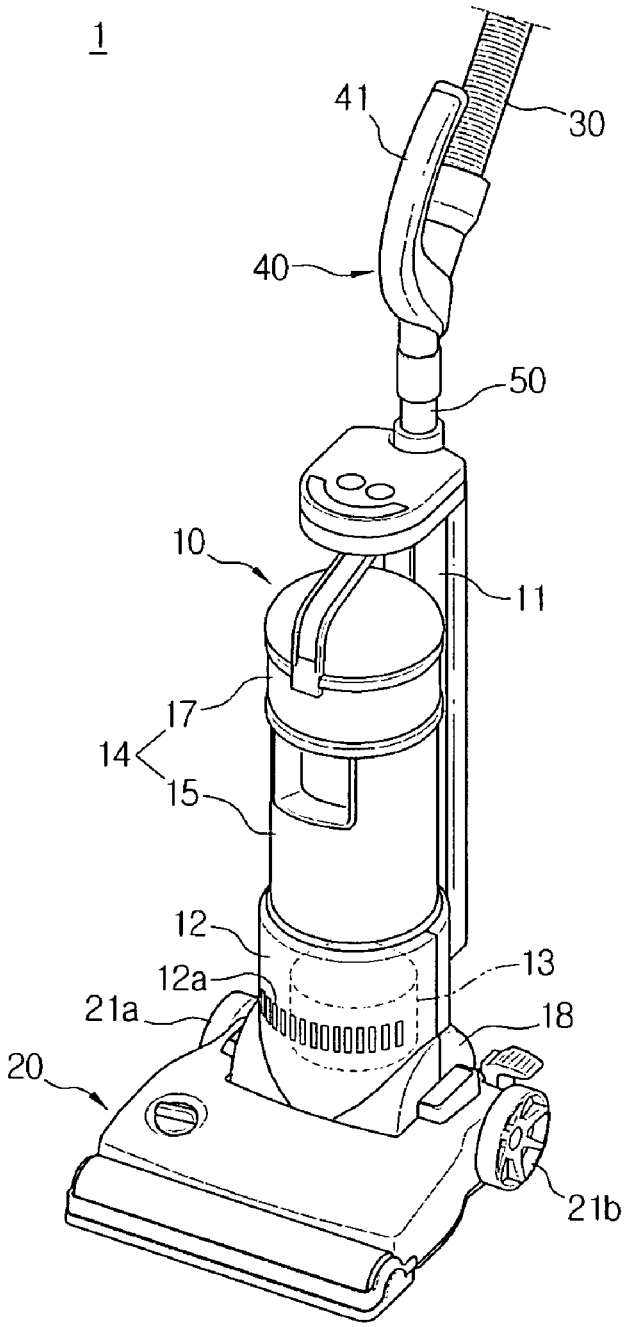
FIG. 1 is a perspective view illustrating a vacuum cleaner according to a first exemplary embodiment of the present disclosure.
Figure 2:
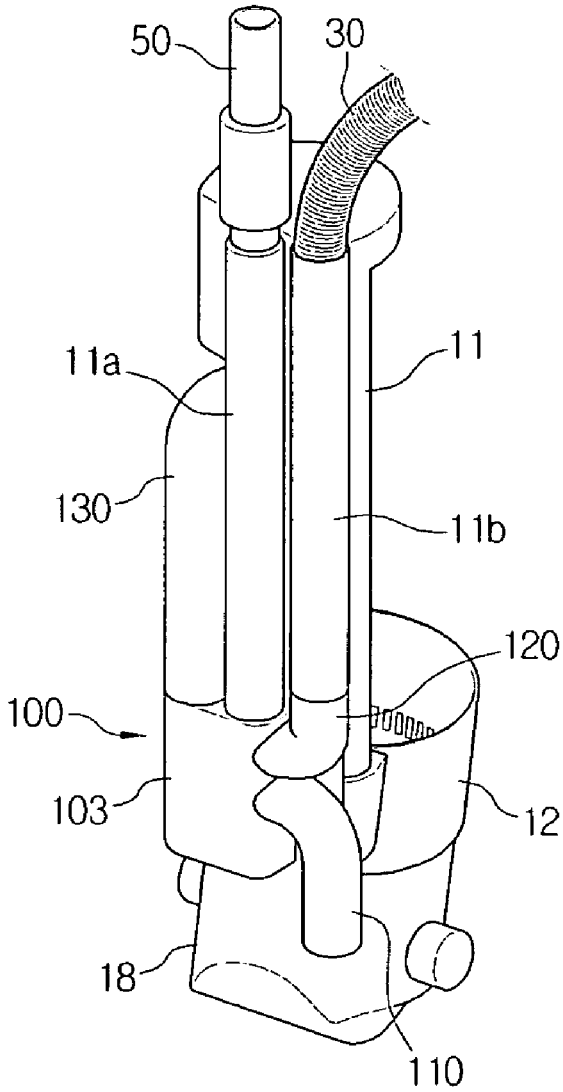
FIG. 2 is a perspective view schematically illustrating a suction path switching unit mounted on the back of a body frame of the vacuum cleaner of FIG. 1.

FIG. 1 shows a vacuum cleaner 1 according to a first exemplary embodiment of the present disclosure. Referring to FIGS. 1 and 2, the vacuum cleaner 1 according to the first exemplary embodiment of the present disclosure. Vacuum cleaner 1 is configured for use in both an upright form and a canister form, includes a main body 10, a suction inlet body 20, an extension pipe assembly 40, and a suction path switching unit 100.

The main body 10 includes a body frame 11, a suction motor 13, and a dust collecting unit 14. The suction inlet body 20 is hingedly connected to a hinge member 18 on a lower side of the body frame 11, and the suction motor 13 is mounted in a motor casing 12. The dust collecting unit 14, which includes a dust receptacle 15 and a dust separator 17, is mounted above the suction motor 13. As illustrated in FIG. 2, the body frame 11 has a socket 11*a* longitudinally disposed on the back thereof, and the extension pipe 50 is inserted into the socket 11*a*. A hose 30 fluidly communicates with one side of the socket 11*a*, and a suction passage 11*b* is formed in parallel with the socket 11*a*.

The suction motor 13 is disposed inside the motor casing 12, which is disposed under the body frame 11. The suction motor 13 fluidly communicates with the dust separator 17 such that air from which dust is separated by the dust separator 17 is discharged to the outside through an air discharge hole 12*a* of the motor casing 12.

The dust separator 17 separates dust from air drawn in using a suction force exerted from the suction motor 13, and the separated dust is then collected in the dust receptacle 15 disposed under the dust separator 17. The dust separator 17 may desirably adopt a cyclone structure that separates dust from air using the centrifugal force. However, this should not be considered as limiting and a dust-bag (not shown) may be employed to collect dust instead of the cyclone structure.

The suction inlet body 20 includes a suction inlet (not shown) disposed on a bottom surface thereof to draw in dust and air from a surface to be cleaned while being in fluid communication with a first suction duct 10 (referring to FIG. 2) of the suction path switching unit 100 to be described later, and includes a pair of traveling wheels 21*a* and 21*b* (referring to FIG. 1) disposed at opposite rear sides of the suction inlet body 20 to easily travel over the surface to be cleaned. Here, the pair of traveling wheels 21*a* and 21*b* is rotatably connected to the suction inlet body 20.

The extension pipe assembly 40 includes a hose 30, a manipulation handle 41, and an extension pipe 50. The hose 30 is flexible in its length, and one side thereof fluidly communicates with one side of the manipulation handle 41 and the opposite side thereof fluidly communicates with the suction passage 11*b*, which is connected in fluid communication with a second suction duct 120 of the suction path switching unit 100 to be described later. The manipulation handle 41 includes a grip unit through which a user may grip the handle and is disposed between the hose 30 and the extension pipe 50 to allow fluid communication therebetween.

The extension pipe 50 has a predetermined length, and is withdrawn from the socket 11*a* in order to be used, and an extra accessory nozzle (not shown) is attached to a free end 51 (see FIG. 3) of the extension pipe 50 so that the vacuum cleaner can act as a canister vacuum cleaner using the extension pipe 50. When not in use, the extension pipe 50 is inserted into the socket 11*a* and fixed to the body frame 11, and the suction path is changed, so that the vacuum cleaner can act as an upright vacuum cleaner drawing in dust and air through the suction inlet body 20. That is, a push projection 141 (see FIG. 3) is pressed or released as the extension pipe 50 is inserted into or withdrawn from the socket 11*a*, and according to the operation of the push projection 141, the suction path for dust and air may be switched to a first suction path P1 (FIG. 3) or a second suction path P2 (FIG. 4).

The extension pipe 50 may have a telescopic structure so that the length thereof can be adjusted when the vacuum cleaner acts as a canister vacuum cleaner. Additionally, the extension pipe 50 may be designed to be higher than the body frame 11 so that a user can easily push and pull the suction inlet body 20 in an upright cleaning mode.

Figure 3:
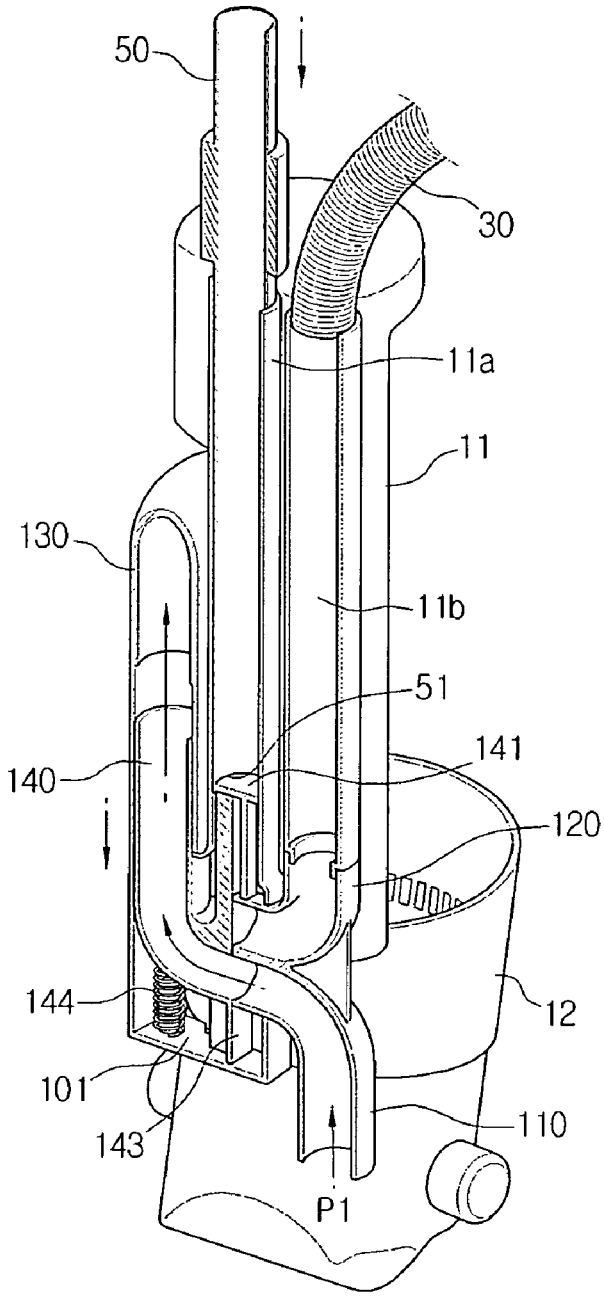
FIGS. 3 and 4 are schematic cross-sectional views illustrating operational states of the suction path switching unit of FIG. 2.
Figure 4:
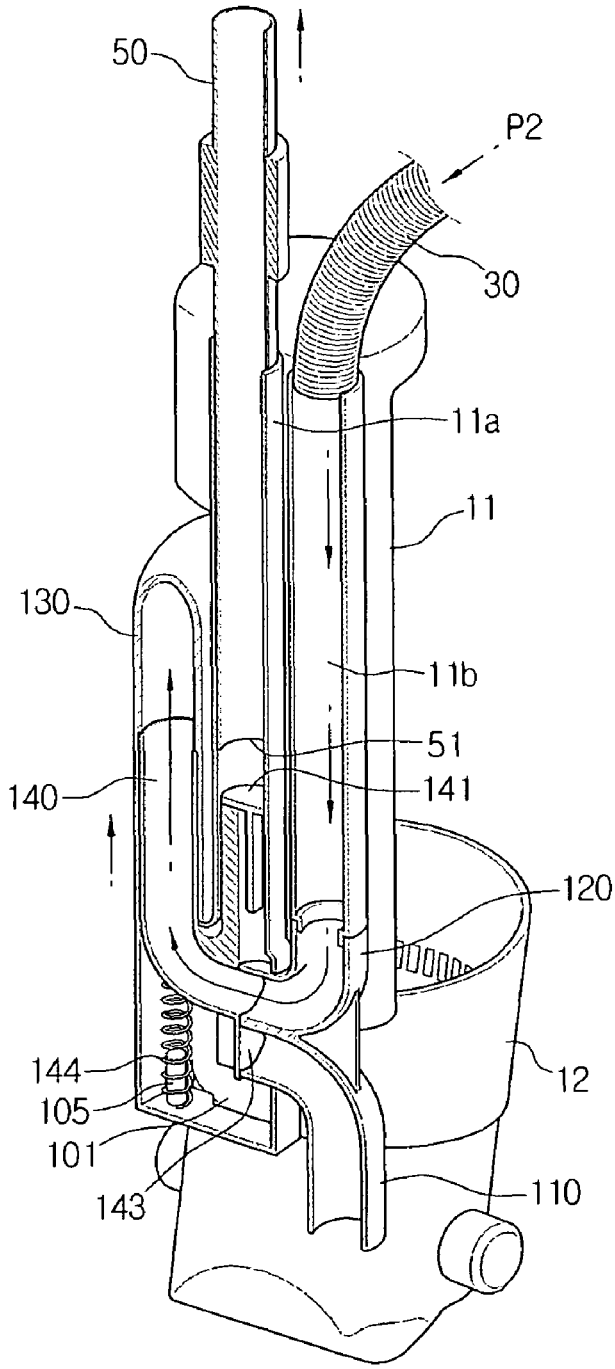

Referring to FIGS. 2 to 4, the suction path switching unit 100 according to the first exemplary embodiment of the present disclosure will now be described. The suction path switching unit 100 includes a first suction duct 110, a second suction duct 120, a guide duct 130 and a switching duct 140.

One side of the first suction duct 110 is in fluid communication with the suction inlet body 20, and an opposite side is bent so as to be inserted into a path switching chamber 101 (see FIGS. 3 and 4). One side of the second suction duct 120 is in fluid communication with the suction passage 11*b*, and an opposite side is bent so as to be inserted into the path switching chamber 101. In this situation, the opposite sides of the first suction duct 110 and second suction duct 120 are vertically parallel in a relation corresponding to a moving section of the switching duct 140 to each other. In this manner, as the switching duct 140 moves up as shown in FIG. 4, the switching duct 140 fluidly communicates with the second suction duct 120 to define the second suction path P2. In contrast, as the switching duct 140 moves down as shown in FIG. 3, the switching duct 140 fluidly communicates with the first suction duct 110 to define the first suction path P1. Accordingly, ends of the opposite sides of the first and the second suction ducts 110 and 120 may be disposed on the same perpendicular line. Here, the path switching chamber 101 may be protected from any external shock by a cover 103.

One end of the guide duct 130 is in fluid communication with the dust separator 17, and is disposed vertically in parallel with one side of the socket 11*a*. Additionally, the guide duct 130 guides dust and air drawn in from the switching duct 140 to the dust separator 17.

One side of the switching duct 140 is slidably inserted into the guide duct 130, and an opposite side is bent and extends a distance sufficient to be selectively in contact with the opposite side of the first suction duct 110 or with the opposite side of the second suction duct 120. The push projection 141 inserted into the socket 11*a* is integrally formed on an outer circumference of the switching duct 140, and a return spring 144 mounted in the path switching chamber 101 is disposed below the switching duct 140 to elastically and upwardly support the opposite side of the switching duct 140. A lower end of the return spring 144 is fixed by a fixing projection 105 (see FIG. 4) disposed inside the path switching chamber 101, and an upper end is fixed in a predetermined position on the lower outer circumference of the switching duct 140.

In this situation, when the extension pipe 50 is inserted into the socket 11*a* as shown in FIG. 3, the switching duct 140 is in fluid communication with the first suction duct 110 while sliding down to a first position (see FIG. 3) along the guide duct 130 as the push projection 141 is pressed by the extension pipe 50. Alternatively, when the extension pipe 50 is withdrawn from the socket 11*a* as shown in FIG. 4, the switching duct 140 is in fluid communication with the second suction duct 120 while sliding upwards to a second position (see FIG. 4) by the return spring 144 as a force that has been imposed on the push projection 141 by the extension pipe 50 is removed.

A partition 143 extends from a lower end of the switching duct 140. As shown in FIG. 4, when the switching duct 140 is in fluid communication with the second suction duct 120, the partition 143 blocks the first suction duct 110 so that it is possible to prevent dust from flowing into the path switching chamber 101 through the first suction duct 110 in advance.

Hereinafter, a process of switching between the first suction path P1 and the second suction path P2 through the suction path switching unit 100 of the vacuum cleaner 1 according to the first exemplary embodiment of the present disclosure constructed as described above will now be described with reference to FIGS. 3 and 4.

As shown in FIG. 3, in order to draw in dust and air from a surface to be cleaned through the suction inlet body 20, the extension pipe 50 is inserted into the socket 11*a*. In this case, as the push projection 141 is pressed down by the free end 51 of the extension pipe 50, the switching duct 140 integrally formed with the push projection 141 moves down to compress the return spring 144, so that the switching duct 140 may be in fluid communication with the first suction duct 110 and the first suction path P1 may be ensured.

If the suction motor 13 is driven in this state, dust and air are drawn into the suction inlet body 20 through a suction inlet (not shown) of the suction inlet body 20 in contact with the surface to be cleaned, and then flow into the switching duct 140 through the first suction duct 110. The dust and air passing through the switching duct 140 then flow into the dust separator 17 along the guide duct 130, and the dust is then separated from the air by the centrifugal force and collected in the dust receptacle 15 due to its own weight. The air separated from the dust is discharged to the outside through a discharge outlet (not shown) of the dust separator 17 in fluid communication with the suction motor 13 and then through the suction motor 13.

On the other hand, in order to perform a canister cleaning operation using the extension pipe 50, the extension pipe 50 is withdrawn from the socket 11*a* as shown in FIG. 4. Accordingly, the push projection 141 that has been pressed by the extension pipe 50 is released by the extension pipe 50, and the switching duct 140 thus moves upwards due to the elastic force of the return spring 144.

In this situation, the switching duct 140 fluidly communicates with the second suction duct 120 instead of the first suction duct 110 so that the suction path may be switched from the first suction path P1 to the second suction path P2 and the partition 143 blocks the first suction duct 110.

In this state, if an appropriate accessory nozzle (not shown) is mounted on the free end 51 of the extension pipe 50 withdrawn from the socket 11*a* and the suction motor 13 is driven, dust and air flow into the suction passage 11*b* after passing in sequence through the accessory nozzle, the extension pipe 50, the manipulation handle 41, and the hose 30.

The dust and air drawn into the suction passage 11*b* flows into the switching duct 140 through the second suction duct 120, and then into the dust separator 17 through the guide duct 130. The dust drawn into the dust separator 17 is separated from the air by the centrifugal force in the dust separator 17 and collected in the dust receptacle 15 due to its own weight, and the air from which the dust is separated is discharged to the outside through the discharge outlet (not shown) of the dust separator 17 fluidly communicating with the suction motor 13 and then through the suction motor 13.

As described above, according to the first exemplary embodiment of the present disclosure, the suction path can be switched using the switching duct 140, which is capable of selectively fluidly communicating the guide duct 130 with the first suction duct 110 or the second suction duct 120, rather than by closing and opening an extra space. Therefore, unnecessary pressure loss and air-flowing noise on the suction path can be prevented when the suction path is switched.

Figure 5:
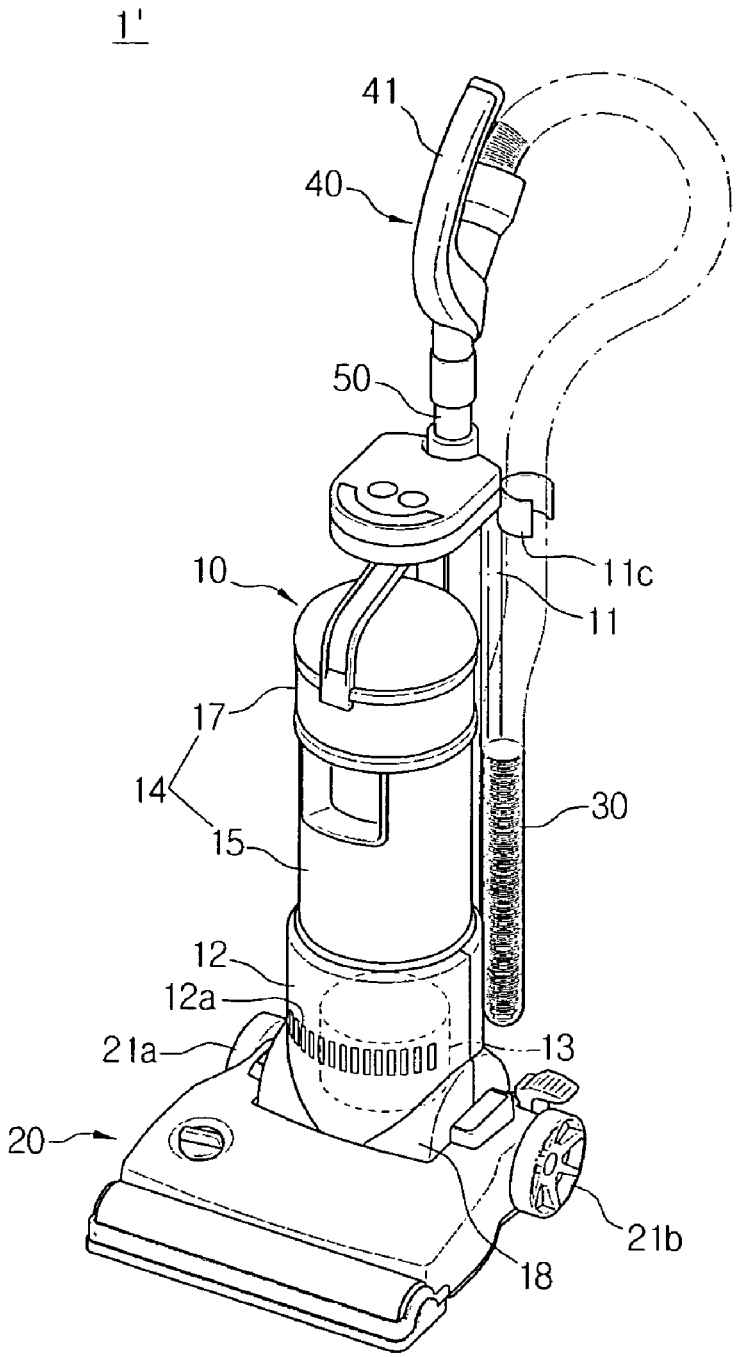
FIG. 5 is a perspective view illustrating a vacuum cleaner according to a second exemplary embodiment of the present disclosure.
Figure 6:
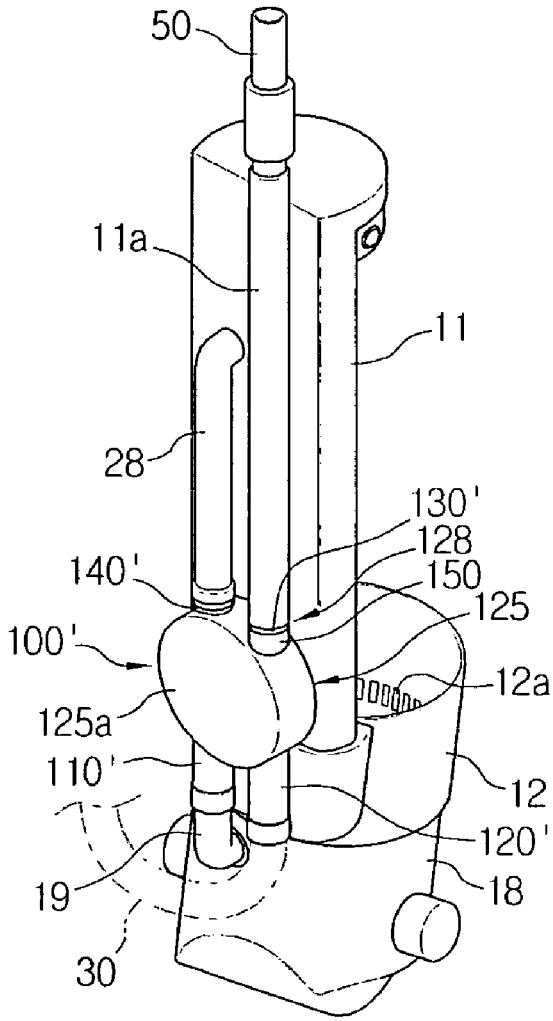
FIG. 6 is a perspective view schematically illustrating a suction path switching unit mounted on the back of a body frame of the vacuum cleaner of FIG. 5.

FIGS. 5 through 9 show a vacuum cleaner 1' according to a second exemplary embodiment of the present disclosure. Referring to FIGS. 5 and 6, the vacuum cleaner 1' according to the second exemplary embodiment of the present disclosure is configured for use in both an upright form and a canister form. Vacuum cleaner 1' includes a main body 10, a suction inlet body 20, an extension pipe assembly 40, and a suction path switching unit 100'. Here, since the construction of the main body 10, the suction inlet body 20 and the extension pipe assembly 40 are the same as those of the vacuum cleaner 1 according to the first exemplary embodiment detailed description thereof will be omitted. However, vacuum cleaner 1' includes a socket 11*a* that is extended to a pushing part mount 150 of the suction path switching unit 100' to be described later and a hose 30 is hung on a fixing portion 11*c* of the body frame 11 with a second end thereof connected in direct fluid communication with a second suction duct 120' of the suction path switching unit 100' also to be described later.

Referring to FIGS. 6 through 9, the suction path switching unit 100' is disposed on the back of the body frame 11 to switch a suction path, and includes a first suction duct 110', a second suction duct 120', a housing 125, a guide duct 140', and a switch operating part 128.

A lower end of the first suction duct 110' is connected in fluid communication with a first connecting duct 19 disposed in a hinge member 18 on a lower side of the body frame 11, and an upper end is fixed to one side of a lower part of the housing 125 so at to be in fluid communication with the inside of the housing 125. Here, the first connecting duct 19 is rotatably connected with an air path (not shown) of the suction inlet body 20 to be in fluid communication with the air path even though the suction inlet body 20 is pivoted to the hinge member 18.

A lower end of the second suction duct 120' is connected in fluid communication with the hose 30, and an upper end is fixed to the other side of the lower part of the housing 125 so at to be in fluid communication with the inside of the housing 125.

The housing 125 is made up of a cylindrical body, which is closed up by a cover 125*a* (see FIG. 6). A switching duct 126 is disposed in the housing 125, and includes a fixing part 161, a moving part 165, and a connecting part 168.

The fixing part 161 is fixed in the housing 125 to be in fluid communication with a lower end of the guide duct 140' within the housing.

The moving part 165 is disposed, so that it can be selectively displaced to a first position (see FIG. 7) or a second position (see FIG. 8) by the switch operating part 128 within the housing 125. Here, the first position is a position where the moving part 165 is moved by the switch operating part 128 to open a first suction path P1' flowing from the suction inlet body 20 to the dust collecting unit 14 as an extension pipe 50 of the extension pipe assembly 40 is inserted into and fixed in the socket 11*a* of the body frame 11, and the second position is a position where the moving part 165 is moved by the switch operating part 128 to open a second suction path P2' flowing from the extension pipe 50 to the dust collecting unit 14 as the extension pipe 50 is withdrawn and removed from the socket 11*a* of the body frame 11.

Figure 7:
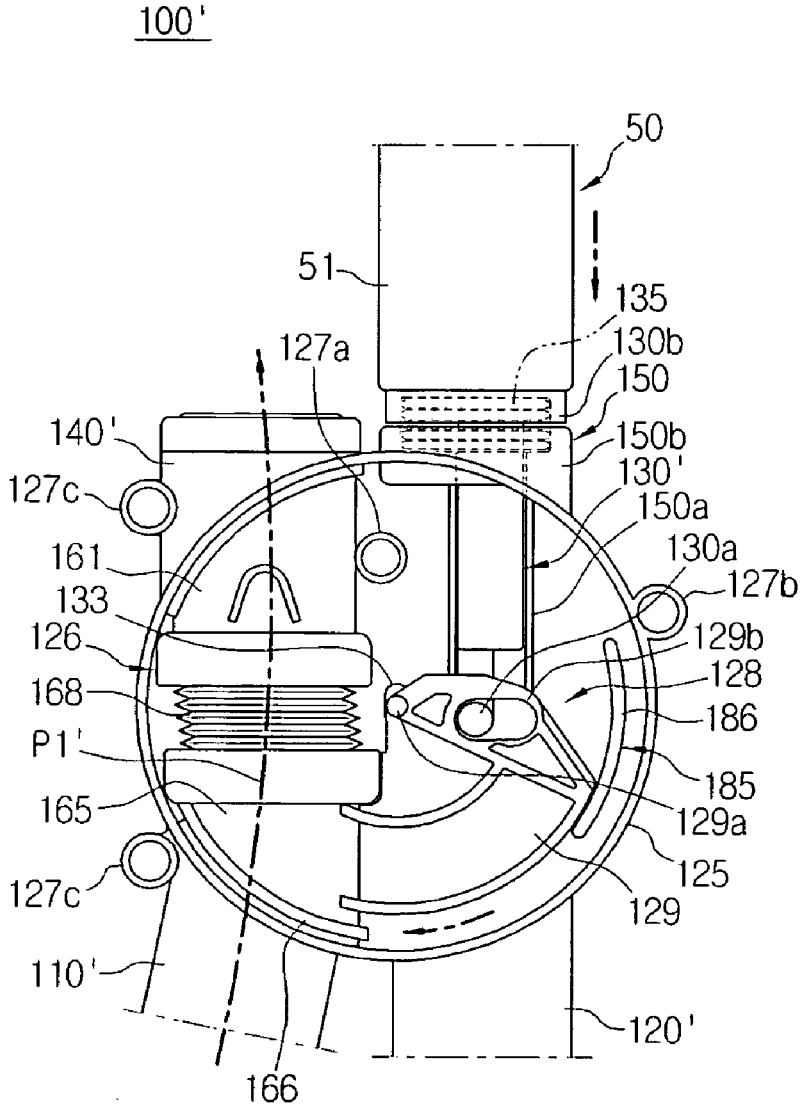
FIGS. 7 and 8 are schematic cross-sectional views illustrating operational states of the suction path switching unit of FIG. 6 in a state where a cover is removed from a housing.
Figure 8:
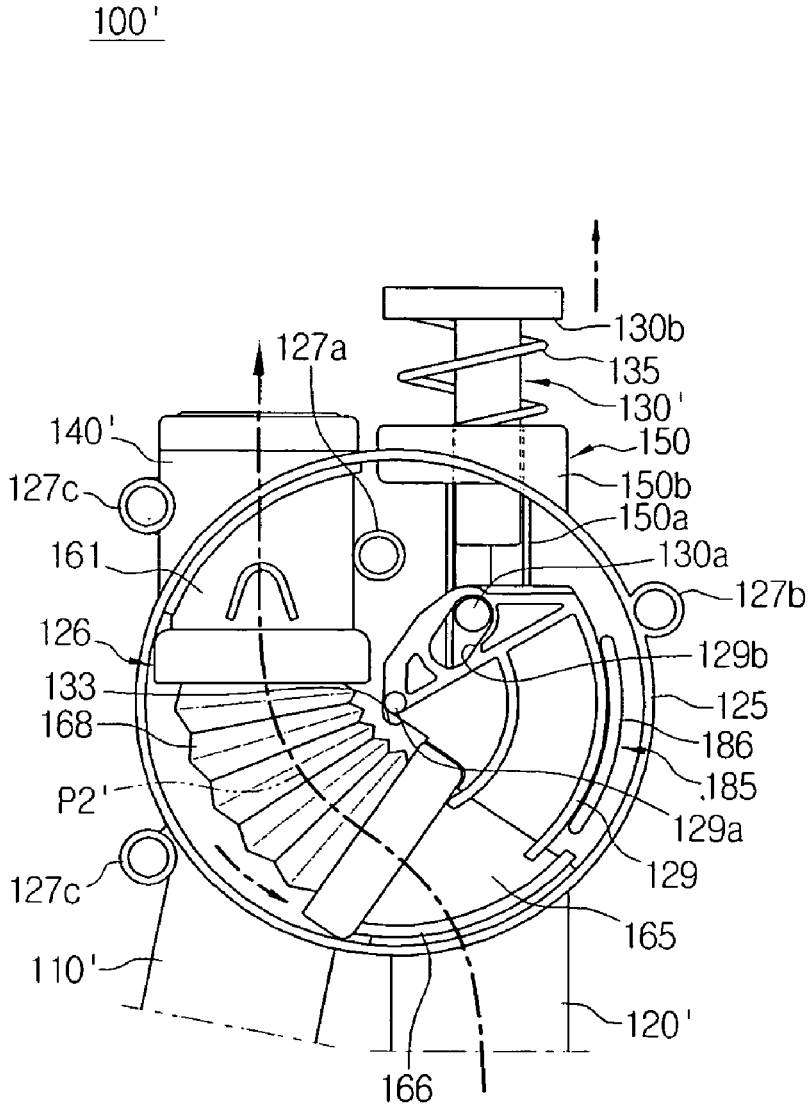

A lower end, that is, a free end of the moving part 165 is formed in the form of a curved surface leaned to one side to conform to an inner surface of the housing 125. The free end of the moving part 165 is in fluid communication with the upper end of the first suction duct 110' when the moving part 165 is displaced to the first position as shown in FIG. 7, and in fluid communication with the upper end of the second suction duct 120' when the moving part 165 is displaced to the second position as shown in FIG. 8. At this time, to seal between the upper end of the first suction duct 110' or the second suction duct 120' and the free end of the moving end 165, a gasket 166 may be desirably disposed on the free end of the moving part 165 with material of low friction and wear property.

The connecting part 168 does not only interconnect the fixing part 161 and the moving part 165, but also allows the moving part 165 to be selectively displaced to the first position or the second position by the switch operating part 128. To achieve this, the connecting part 168 may be formed of a bellows type hose, which is bendable and capable of expansion and contraction.

A lower end of the guide duct 140' is in fluid communication with one side of an upper part of the housing 125, and an upper end is connected in fluid communication with a second connecting duct 28 connected with the dust collecting unit 14.

Figure 9:
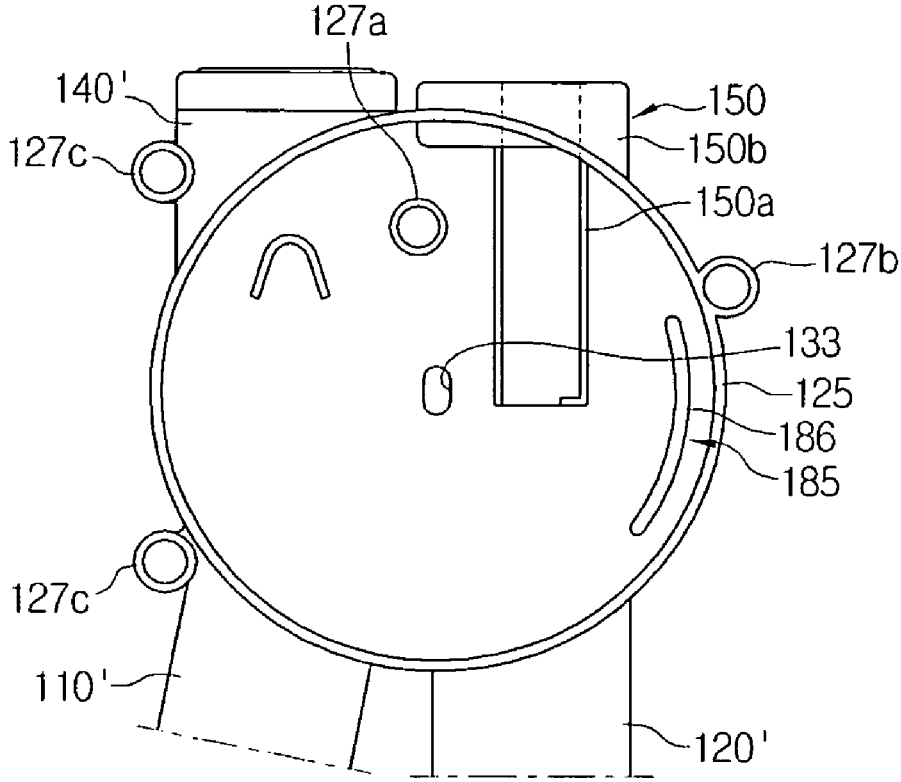
FIG. 9 is a front view illustrating only the housing of the suction path switching unit of FIGS. 7 and 8.

To fix the suction path switching unit 100' on the back of the body frame 11 with screws, as shown in FIG. 9, an inner fixing boss 127*a* and a first outer fixing boss 127*b* are disposed on an inner bottom surface and one side of an outer part of the housing 125, respectively, and second outer fixing bosses 127*c* are disposed on one sides of outer parts of the guide duct 140' and the first suction duct 110'.

The switch operating part 128 is installed within the housing 125. As shown in FIG. 7 or 8, the switch operating part 128 functions to selectively displace the moving part 165 of the switching duct 126 to the first position or the second position in cooperation with operation of fixing or separating the free end 51 of the extension pipe 50 of the extension pipe assembly 40 in or from the socket 11*a* of the body frame 11. For this, the switch operating part 128 includes a rotating lever 129, a pushing part 130', and a returning spring 135.

The rotating lever 129 at one end thereof is connected to the moving part 165 of the switching duct 126, and at one side of an opposite end thereof, is rotatably supported on the inner bottom surface of the housing 125. At this time, to allow the rotating lever 129 to rotate while being slightly moved when it is rotated, the housing 125 has a supporting hole 133 formed in the form of a vertical oval at a center of the inner bottom surface of the housing 125, and the one side of the opposite end of the rotating lever 129 has a supporting axis 129*a* displaceably and rotatably supported in the supporting hole 133. Accordingly, when the rotating lever 129 is rotated from a position of FIG. 7 (the first position of the moving part 165 of the switching duct 126) to a position of FIG. 8 (the second position of the moving part 165 of the switching duct 126), or from the position of FIG. 8 to the position of FIG. 7, the supporting axis 129*a* is slightly moved and then supported on a lower side or an upper side of the supporting hole 133. Thus, at this time, the gasket 166 on the lower end of the moving part 165 of the switching duct 126 can be moved while being scarcely rubbed with the inner surface of the housing 125.

A lower end of the pushing part 130' is hinged to the other side of a center of the opposite end of the rotating lever 129. For this, a hinge projection 130*a* is formed on the lower end of the pushing part 130', and a hinge hole 129*b* is formed in the form of an oval on the center of the opposite end of the rotating lever 129 to accommodate and support the hinge projection 130*a*. In addition, the pushing part 130' is disposed, so that a center portion thereof is guided by a penetrated hole of a support 150*b* and a moving guide 150*a* (see FIG. 9) of the pushing part mount 150 is formed on the inner bottom surface of the housing 125 and an upper end thereof has a supporting portion 130*b*, which engages with the free end 51 of the extension pipe 50.

As shown in FIG. 8, the return spring 135 is disposed around the center portion of the pushing part 130' between the supporting portion 130*b* of the pushing part 130' and the support 150*b* of the pushing part mount 150. The returning spring 135 at an upper end thereof is supported in a seating recess formed on an undersurface of the supporting portion 130*b*, and at a lower end thereof, is supported in a seating recess formed on an upper surface of the support 150*b*, so that it elastically supports the pushing part 130' to urge the supporting portion 130*b* in an outward direction of the housing 125, that is, in a upward direction. Accordingly, when the extension pipe 50 is inserted into and fixed in the socket 11*a* of the body frame 11, the returning spring 135 is compressed as the supporting portion 130*b* of the pushing part 130' is pushed by the free end 51 of the extension pipe 50, as shown in FIG. 7. As a result, the pushing part 130' rotates the rotating lever 129 in a clockwise direction on the supporting axis 129*a* supported in the supporting hole 133 thus to displace the moving part 165 of the switching duct 126 to the first position. To the contrary, when the extension pipe 50 is withdrawn and separated from the socket 11*a* of the body frame 11, the returning spring 135 is expanded to return the supporting portion 130*b* of the pushing part 130' to an original position as a pushing force that has been imposed on the supporting portion 130*b* by the free end 51 of the extension pipe 50 is released, as shown in FIG. 8. As a result, the pushing part 130' rotates the rotating lever 129 in a counterclockwise direction on the supporting axis 129*a* thus to displace the moving part 165 of the switching duct 126 to the second position.

As shown in FIGS. 7 through 9, the switch operating part 125 further includes a guide part 185 to guide the rotating lever 129 to correctly rotate.

The guide part 185 is made up of a guide rib 186 projected from the inner bottom surface of the housing 125 within the housing 125 to guide an outer edge surface of the rotating lever 129 when the rotating lever 129 rotates. At this time, a distance between the guide rib 186 and the outer edge surface of the rotating lever 129 may be desirably designed enough to prevent the rotating lever 129 from being deviated and twisted, but not to disturb the rotation of the rotating lever 129.

However, this should not be considered as limiting and the guide part 185 may be configured to include a guide groove (not shown) formed on the rotating lever 129, and a guide rib (not shown) projected opposite to the guide groove on the inner bottom surface of the housing 125.

Hereinafter, a process of switching between the first suction path P1' and the second suction path P2' through the suction path switching unit 100' of the vacuum cleaner 1' according to the second exemplary embodiment of the present disclosure constructed as described above will now be described with reference to FIGS. 5 through 8.

First, referring to FIGS. 5 through 7, in order to draw in dust and air from a surface to be cleaned through the suction inlet body 20, the extension pipe 50 is inserted into the socket 11*a*. As the extension pipe 50 is inserted into the socket 11*a*, the pushing part 130' is operated, so that the center portion is moved down along the penetrated hole of the support 150*b* and the moving guide 150*a* of the pushing part mount 150 while the supporting portion 130*b* is pressed down from a position shown in FIG. 8 by the free end 51 of the extension pipe 50 in a state where it is elastically supported on the return spring 144.

According to this, the rotating lever 129 is rotated in a clockwise direction on the supporting axis 129*a* supported in the supporting hole 133 within the housing 125. At this time, because the supporting axis 129*a* is supported to be rotatable and at the same time, to be displaceable in the supporting hole 133 in the form of the vertical oval, the rotating lever 129 is rotated with being slightly moved while it is guided by the guide part 185.

As the rotating lever 129 is rotated as described above, the moving part 165 of the switching duct 126 connected with the lower end of the rotating lever 129 is moved to a first position while being scarcely rubbed with the inner surface of the housing 125, as shown in FIG. 7. As a result, the first suction dust 110' is in fluid communication with the guide duct 140' through the moving part 165, the connecting part 168 and the fixing part 161 of the switching duct 126 and the first suction path P1' is ensured. At this time, the gasket 166 seals between the free end of the moving part 165 and the upper end of the first suction duct 110'.

If the suction motor 13 is driven in this state, dust and air are drawn into the suction inlet body 20 through a suction inlet (not shown) of the suction inlet body 20 in contact with the surface to be cleaned. The dust and air drawn into the suction inlet body 20 then flow into the dust separator 17 through an air path of the suction inlet body 20, the first connecting duct 19, the first suction duct 110', the switching duct 126, the guide duct 140' and the second connecting duct 28, and the dust is then separated from the air by the centrifugal force and collected in the dust receptacle 15 due to its own weight. The air separated from the dust is discharged to the outside through a discharge outlet (not shown) of the dust separator 17 in fluid communication with the suction motor 13 and then through the suction motor 13.

On the other hand, in order to use the vacuum cleaner 1' in a canister form, that is, to perform a canister cleaning operation using the extension pipe 50, the extension pipe 50 is withdrawn and removed from the socket 11*a*. Accordingly, a pushing force that has been imposed on the supporting portion 130*b* of the pushing part 130' by the extension pipe 50 as shown in FIG. 7 is released, and the pushing part 130' thus moves upwards due to the elastic force of the return spring 135.

In this situation, as the pushing part 130' moves, the rotating lever 129 is rotated in a counterclockwise direction on the supporting axis 129*a* within the housing 125. At this time, because the supporting axis 129*a* is supported to be rotatable and at the same time, to be displaceable in the supporting hole 133 in the form of the vertical oval, the rotating lever 129 is rotated with being slightly moved while it is guide by the guide part 185.

As the rotating lever 129 is rotated as described above, the moving part 165 of the switching duct 126 connected with the lower end of the rotating lever 129 is moved to a second position while being scarcely rubbed with the inner surface of the housing 125, as shown in FIG. 8. As a result, the second suction dust 120' is in fluid communication with the guide duct 140' through the moving part 165, the connecting part 168 and the fixing part 161 of the switching duct 126 and the second suction path P2' is ensured. At this time, the gasket 166 seals between the free end of the moving part 165 and the upper end of the second suction duct 120'.

In this state, if an appropriate accessory nozzle (not shown) is mounted on the free end 51 of the extension pipe 50 withdrawn and removed from the socket 11*a* and the suction motor 13 is driven, dust and air flow into the second suction duct 120' after passing in sequence through the accessory nozzle, the extension pipe 50, the manipulation handle 41, and the hose 30.

The dust and air drawn into the second suction duct 120' flow into the dust separator 17 via the switching duct 126, the guide duct 140' and the second connecting duct 28. The dust drawn into the dust separator 17 is separated from the air by the centrifugal force in the dust separator 17 and collected in the dust receptacle 15 due to its own weight, and the air from which the dust is separated is discharged to the outside through the discharge outlet of the dust separator 17 fluidly communicating with the suction motor 13 and then through the suction motor 13.

As apparent from the forgoing description, according to the exemplary embodiments of the present disclosure, the vacuum cleaner having the suction path switching unit is configured, so that the suction path can be simply diverted into the first suction path fluidly communicating from the suction inlet body to the dust collecting unit or the second suction path fluidly communicating from the extension pipe to the dust collecting unit only by inserting the extension pipe into and withdrawing the extension pipe from the socket of the body frame.

Further, the vacuum cleaner having the suction path switching unit according to the exemplary embodiments of the present disclosure is configured, so that the whole of the switching duct having the fluent air path connected to the guide duct can be moved directly to fluidly communicate with the first suction duct or the second suction duct, thereby minimizing unnecessary pressure loss and air-flowing noise resulting from switching the suction path.

Furthermore, the vacuum cleaner having the suction path switching unit according to the exemplary embodiments of the present disclosure is configured, so that the suction path can be diverted by the switching duct having the connecting part, which is gently bendable and capable of expansion and contraction, so that the moving part is selectively displaced to the first position or the second position by the switch operating part to fluidly communicate with the first suction duct or the second suction duct. Thus, the air passing through the suction path switching unit smoothly moves, so that unnecessary pressure loss and air-flowing noise resulting from switching the suction path may be minimized.

Moreover, the vacuum cleaner having the suction path switching unit according to the exemplary embodiments of the present disclosure is configured, so that the supporting axis of the rotating lever connected with the moving part of the switching duct is supported to be vertically movable and rotatable in the supporting hole in the form of the vertical oval, thereby allowing the moving part to smoothly move without rubbing with the housing to generate a jam or stiction in switching the suction path.

Also, the vacuum cleaner having the suction path switching unit according to the exemplary embodiments of the present disclosure is configured, so that the rotating lever connected with the moving part of the switching duct can be guided by the guide part, thereby allowing the moving part and the rotating lever to be maintained in a correct orientation without generating deviation or twisting in switching the suction path.

The foregoing exemplary embodiments and advantages are merely exemplary and are not to be construed as limiting the present disclosure. The present teaching can be readily applied to other types of apparatuses. Also, the description of the exemplary embodiments of the present disclosure is intended to be illustrative, and not to limit the scope of the claims, and many alternatives, modifications, and variations will be apparent to those skilled in the art.

What is claimed is:

1. A vacuum cleaner, comprising:

a cleaner body having a suction motor, a dust collecting unit, and a body frame in which the suction motor and the dust-collecting unit are disposed;

a suction inlet body hinged to a lower end of the body frame;

an extension pipe assembly detachably fixed on the body frame, the extension pipe assembly having a hose and an extension pipe connected in fluid communication with the hose; and a suction path switching unit disposed on the body frame and having a switching duct, at least a portion of the switching duct is elastic and slideably arranged on a suction path to be displaceable on the suction path, wherein, as the extension pipe is fixed on or separated from the body frame, the portion of the switching duct is selectively slid to a first position of opening a first suction path flowing from the suction inlet body to the dust collecting unit or a second position of opening a second suction path flowing from the extension pipe to the dust collecting unit.

2. The vacuum cleaner as claimed in claim 1, wherein the switching duct is entirely elastic and arranged on the suction path to be movable up and down on the suction path.

3. A vacuum cleaner, comprising:

a cleaner body having a suction motor, a dust collecting unit, and a body frame in which the suction motor and the dust-collecting unit are disposed;

a suction inlet body hinged to a lower end of the body frame;

an extension pipe assembly detachably fixed on the body frame, the extension pipe assembly having a hose and an extension pipe connected in fluid communication with the hose; and a suction path switching unit disposed on the body frame and having a switching duct, which is entirely elastically and arranged on a suction path to be movable up and down on the suction path wherein, as the extension pipe is fixed on or separated from the body frame, the portion of the switching duct is selectively displaced to a first position of opening a first suction path flowing from the suction inlet body to the dust collecting unit or a second position of opening a second suction path flowing from the extension pipe to the dust collecting unit, wherein the suction path switching unit further comprises:

a first suction duct having a first side fluidly communicating with the suction inlet body;

a second suction duct having a first side fluidly communicating with the hose; and a guide duct fluidly communicating with the dust collecting unit, wherein the switching duct at a first side thereof is in fluid communication with the guide duct and at a second side thereof, selectively fluidly communicates with one of the second sides of the first suction duct and the second suction duct.

4. The vacuum cleaner as claimed in claim 3, wherein the switching duct at the first side thereof is slidably inserted into the guide duct, and wherein the second sides of the first suction duct and the second suction duct are arranged on the same vertical line in a relation corresponding to a moving section of the switching duct to each other, such that the switching duct moves up or down to fluidly communicate with the first suction duct or the second suction duct.

5. The vacuum cleaner as claimed in claim 4, wherein the switching duct further comprises a partition extending therefrom, the switching duct being disposed on the same vertical line so that when the switching duct is in the second position the partition blocks the first suction duct.

6. The vacuum cleaner as claimed in claim 3, wherein the switching duct has an upper outer circumference thereof formed integrally with a push projection pressed or released by the extension pipe, the push projection being slidably inserted into a socket formed on the body frame thus to be insertable into or separatable from the socket.

7. The vacuum cleaner as claimed in claim 6, wherein, as the push projection is released by the extension pipe and upwardly and elastically supported by a return spring, the switching duct fluidly communicates with the second suction duct.

8. A vacuum cleaner, comprising:

a cleaner body having a suction motor, a dust collecting unit, and a body frame in which the suction motor and the dust-collecting unit are disposed;

a suction inlet body hinged to a lower end of the body frame;

an extension pipe assembly detachably fixed on the body frame, the extension pipe assembly having a hose and an extension pipe connected in fluid communication with the hose; and a suction path switching unit disposed on the body frame and having a switching duct, at least a portion of the switching duct is elastic and arranged on a suction path to be displaceable on the suction path, wherein, as the extension pipe is fixed on or separated from the body frame, the portion of the switching duct is selectively displaced to a first position of opening a first suction path flowing from the suction inlet body to the dust collecting unit or a second position of opening a second suction path flowing from the extension pipe to the dust collecting unit, and wherein the switching duct elastic portion is formed to be bendable and capable of expansion and contraction.

9. The vacuum cleaner as claimed in claim 8, wherein the suction path switching unit further comprises:

a first suction duct having a first side fluidly communicating with the suction inlet body;

a second suction duct having a first side fluidly communicating with the hose;

a guide duct having a first side fluidly communicating with the dust collecting unit;

a housing which fluidly communicates with second sides of the first suction duct, the second suction duct, and the guide duct, wherein the switching duct is disposed in the housing so that the portion of the switching duct is displaceable to one of the first position and the second position to be in fluid communication with the first suction duct and the second suction duct, respectively, and the rest of the of the switching duct is in fluid communication with the guide duct; and a switch operating part connected to the portion of the switching duct within the housing to selectively displace the portion of the switching duct to one of the first position and the second position in cooperation with an operation of fixing or separating the extension pipe on or from the body frame.

10. The vacuum cleaner as claimed in claim 9, wherein the switching duct comprises:

a fixing part fixed in fluid communication with the guide duct within the housing;

a moving part selectively displaceable to one of the first position and the second position to be in fluid communication with one of the first suction duct and the second suction duct within the housing; and a connecting part formed to be bendable and capable of expansion and contraction and to interconnect the fixing part and the moving part.

11. The vacuum cleaner as claimed in claim 10, wherein the connecting part comprises a bellows type hose.

12. The vacuum cleaner as claimed in claim 10, wherein the moving part comprises a free end fluidly communicating with the first suction duct or the second suction duct, the free end having a gasket disposed to seal between the moving part and the first suction duct or the second suction duct.

13. The vacuum cleaner as claimed in claim 10, wherein the switch operating part comprises:

a rotating lever having a first end that is connected to the moving part and a first side of a second end that is rotatably supported on the housing;

a pushing part having a first side that is hinged to a second side of the second end of the rotating lever and a second side that penetrates through the housing and is exposed to the outside of the housing; and a returning spring to elastically support the pushing part to push the pushing part outside the housing.

14. The vacuum cleaner as claimed in claim 13, wherein the housing has a supporting hole formed in the form of a vertical oval at an inner center of the housing, wherein the first side of the second end of the rotating lever has a supporting axis displaceably supported in the supporting hole.

15. The vacuum cleaner as claimed in claim 13, wherein the switch operating part further comprises a guide part to guide the rotating lever to correctly rotate.

16. The vacuum cleaner as claimed in claim 15, wherein the guide part comprises a guide rib projected from the housing within the housing to guide an outer edge of the rotating lever when the rotating lever rotates.

* * * * *